US007005593B2

(12) United States Patent
Gasparyan et al.

(10) Patent No.: US 7,005,593 B2
(45) Date of Patent: Feb. 28, 2006

(54) LIQUID ELECTRICAL MICROSWITCH

(75) Inventors: Arman Gasparyan, New Providence, NJ (US); Timofei Nikita Kroupenkine, Warren, NJ (US); Joseph Ashley Taylor, Springfield, NJ (US); Donald Weiss, Cresskill, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 47 days.

(21) Appl. No.: 10/816,569

(22) Filed: Apr. 1, 2004

(65) Prior Publication Data

US 2005/0217984 A1 Oct. 6, 2005

(51) Int. Cl.
*H01H 29/00* (2006.01)

(52) U.S. Cl. ..... 200/182; 200/199; 200/214; 200/233; 335/78; 335/57

(58) Field of Classification Search ..... 200/182, 200/190–193, 199, 216, 219, 233; 335/47, 335/58, 78
See application file for complete search history.

(56) References Cited

U.S. PATENT DOCUMENTS 6,185,961 B1 2/2001 Tonucci et al.
6,323,447 B1 * 11/2001 Kondoh et al. ..... 200/182

OTHER PUBLICATIONS

U.S. Appl. No. 10/798,064, filed Mar. 11, 2004, Arney et al.
U.S. Appl. No. 10/806,543, filed Mar. 23, 2004, Arney et al.
U.S. Appl. No. 10/816,569, filed Apr. 1, 2004, Gasparyan et al.
U.S. Appl. No. 10/674,448, filed Sep. 30, 2003, Hodes et al.
U.S. Appl. No. 10/803,565, filed Mar. 18, 2004, Hodes et al.
U.S. Appl. No. 10/803,641, filed Mar. 18, 2004, Hodes et al.
U.S. Appl. No. 10/403,159, filed Mar. 31, 2003, Kornblit et al.
U.S. Appl. No. 10/649,285, filed Aug. 27, 2003, Kornblit et al.
U.S. Appl. No. 10/716,084, filed Nov. 18, 2003, Kroupenkine et al.
U.S. Appl. No. 10/803,576, filed Mar. 18, 2004, Kroupenkine et al.

(Continued)

*Primary Examiner*—Richard K. Lee
(74) *Attorney, Agent, or Firm*—Donald P. Dinella; David W. Herring

(57) ABSTRACT

A liquid electrical switch is disclosed that uses a plurality of droplets of conducting liquid to form an electrical path. In a first embodiment, at least a first voltage differential is used to create a separation distance between two droplets. The droplets are illustratively contained within a housing and surrounded by an immiscible, insulating liquid. In this embodiment, the at least a first voltage differential draws at least a portion of at least one of the droplets away from a second droplet, thus preventing electrical current from flowing from the at least one droplet to the second droplet. In another embodiment, the at least a first voltage differential is changed in a way such that at least one liquid droplet is made to come into contact with a second droplet, thus creating an electrical path between the two droplets.

12 Claims, 4 Drawing Sheets

OTHER PUBLICATIONS

U.S. Appl. No. 10/810,774, filed Mar. 26, 2004, Kroupenkine et al.

Kim, et al., *"Nanostructured Surfaces for Dramatic Reduction of Flow Resistance in Droplet-Based Microfluidics,"* IEEE, pp. 479-482 (2002).

J. Kim et al., "A Micromechanical Switch With Electrostatically Driven Liquid-Metal Droplet," Sensor Actuators A-Phys 97-8: 672-679, Apr. 1, 2002.

L. Latorre et al., "Electrostatic Actuation of Microscale Liquid-Metal Droplets," Journal Of Microelectromechanical Systems, vol. 11, No. 4, Aug. 2002, pp. 302-308.

J. Simon, S. Saffer, and C-J. Kim, A Liquid-Filled Microrelay with a Moving Mercury Microdrop:, Journal of Microelectromechanical Systems, vol. 6, No. 3, Sep. 1997, pp. 208-216.

* cited by examiner

LIQUID ELECTRICAL MICROSWITCH

FIELD OF THE INVENTION

The present invention relates to electrical switches and, more particularly, to liquid electrical microswitches.

BACKGROUND

Small relays and switches, known as microswitches, are used in a wide variety of applications, such as automotive, test equipment, switchboard and telecommunications applications, for a wide variety of purposes. Due to the general trend of miniaturization of electronics, there is a growing need for ever-smaller relays and switches. Thus, a great deal of research has been conducted in the miniaturization of traditional electromechanical switches. However, traditional electromechanical switches, such as that switch shown in FIG. 1, tended to be inherently unreliable due to their mechanical nature—at some point the moving parts and/or the physical electrical contacts within the switches failed.

Referring to FIG. 1, illustrative prior art electromechanical switch 100 has load contacts 101*a* and 102*a* connected to arms 101 and 102, respectively. When an input voltage is applied to coil mechanism 111, the input voltage magnetizes the core 110, which pulls arm 106 and contact 108 toward contact 109 of core 110 in direction 107. This action causes, in turn, contact 103 on arm 105 to move upward in direction 104, thus physically pushing arm 102 upward in a way such that the load contacts 101*a* and 102*a* come into contact with each other, thereby closing the load circuit. When the input voltage is removed from coil 111, the spring lever 113 functions to push the contacts 101*a* and 102*a* away from each other, thus breaking the load circuit connection.

As discussed above, switch 100 must inherently make mechanical contacts in order to switch a load. At the point of these contacts, oxidation breakdown occurs over time at which point the switch will require maintenance or replacement. When switch 100 is activated, there is a window of time during which the load circuit flickers between an open and a closed state. This phenomenon, referred to as "bounce", creates a delay between the time current is applied and the time the circuit is switched, thus creating a condition which may need to be considered in load design.

More recently, research efforts have focused on the development of miniature Microelectromechanical Systems (MEMS) switches which are, for example, fabricated using integrated circuit manufacturing processes, typically resulting in a lower production cost. However such switches are still somewhat unreliable because MEMS switches, similar to the electromechanical switch 100 of FIG. 1, typically are characterized by solid contacts that must be brought into contact with each other to close the switch. Accordingly, while MEMS switches are less costly than larger scale electromechanical switches, the aforementioned problems with electromechanical switches remain. Specifically, the solid-to-solid contact surfaces required in such switches suffer from the same oxidation/degradation during normal cycling. At relatively smaller scales, this can result in increased contact resistance, stiction, or microwelding at high throughput power.

In order to prevent the aforementioned problems associated with small electromechnical switches, other efforts have focused on solid state relays (SSRs). FIG. 2 shows a typical prior art Metal Oxide Semiconductor Field-Effect Transistor (MOSFET)-based SSR 200. Specifically, an input current is applied to light-emitting diode 201, which is illustratively a Gallium Arsenide (GaAs) infrared LED, via leads 202 and 203. The resulting emitted light 204 is reflected within an optical dome 205 onto a series of photo diodes 206 in photodiode array 206*a*. The photodiodes generate a voltage which is passed to driver circuitry 207 which, as is well known, is used to control the gates of two MOSFETs 208 and, accordingly, to switch a load 209.

All of the components of SSR 200 are, for example, fabricated out of semiconductor material and as a result, the solid state relay combines many operational characteristics not found in other types of devices. Because there are no moving parts, in contrast to the aformentioned electromechanical switches, solid state relays are characterized by relatively long switching lives and exhibit bounce-free operation. Additionally, the input LEDs require low signal levels, thus making such SSR switches attractive in low power applications.

While SSRs are, for the above reasons, advantageous in many applications, they are also limited in their usefulness in certain respects. Specifically, such devices may experience a relatively high degree of current leakage and, thus, may be relatively inefficient. Also, SSRs are typically limited in the power they can carry and, accordingly, are likewise limited in the ability to switch higher loads. Finally, SSRs are relatively expensive to manufacture compared to electromechanical and/or MEMs-based devices, thus increasing the cost of devices that use SSRs.

In order to address some of the above limitations, recent attempts have focused on developing liquid based microswitches. Such attempts are described in, for example, J. Kim et al., "A micromechanical switch with electrostatically driven liquid-metal droplet,", SENSOR ACTUAT A-PHYS 97–8: 672–679 Apr. 1, 2002; L. Latorre et al., "Electrostatic actuation of microscale liquid-metal droplets," JOURNAL OF MICROELECTROMECHANICAL SYSTEMS, VOL. 11, NO. 4, AUGUST 2002 and J. Simon, S. Saffer, and C.-J. Kim, "A Liquid-Filled Microrelay with a Moving Mercury Micro-Drop", J. Microelectro-mechanical Systems, Vol. 6, No. 3, September 1997, pp. 208–216, which are hereby incorporated by reference herein in their entirety. As described in these references, typical prior liquid switches use a movable liquid droplet that either comes into contact or separates from the solid electrodes, thus connecting or disconnecting electrical circuit. Such an approach is limited in that the wetting and electrochemical phenomena at the liquid-solid contact interface can be relatively unreliable.

SUMMARY OF THE INVENTION

The present inventors have realized that, for the foregoing reasons, there remains a need for an efficient, long-life electrical microswitch that is relatively low cost to manufacture. Therefore, the present inventors have invented a microswitch that essentially eliminates the problems associated with prior devices, as discussed above. Specifically, the present inventors have invented a liquid electrical switch that uses a plurality of droplets of conducting liquid to form an electrical path. In a first embodiment, at least a first voltage differential is used to create a separation distance between two droplets. The droplets are illustratively contained within a housing and surrounded by an immiscible, insulating liquid. In this embodiment, the at least a first voltage differential draws at least a portion of at least one of the droplets away from a second droplet, thus preventing electrical current from flowing from the at least one droplet to the second droplet.

In another embodiment, the at least a first voltage differential is changed in a way such that at least one liquid droplet is made to come into contact with a second droplet, thus creating an electrical path between the two droplets.

DETAILED DESCRIPTION

Figure 1:
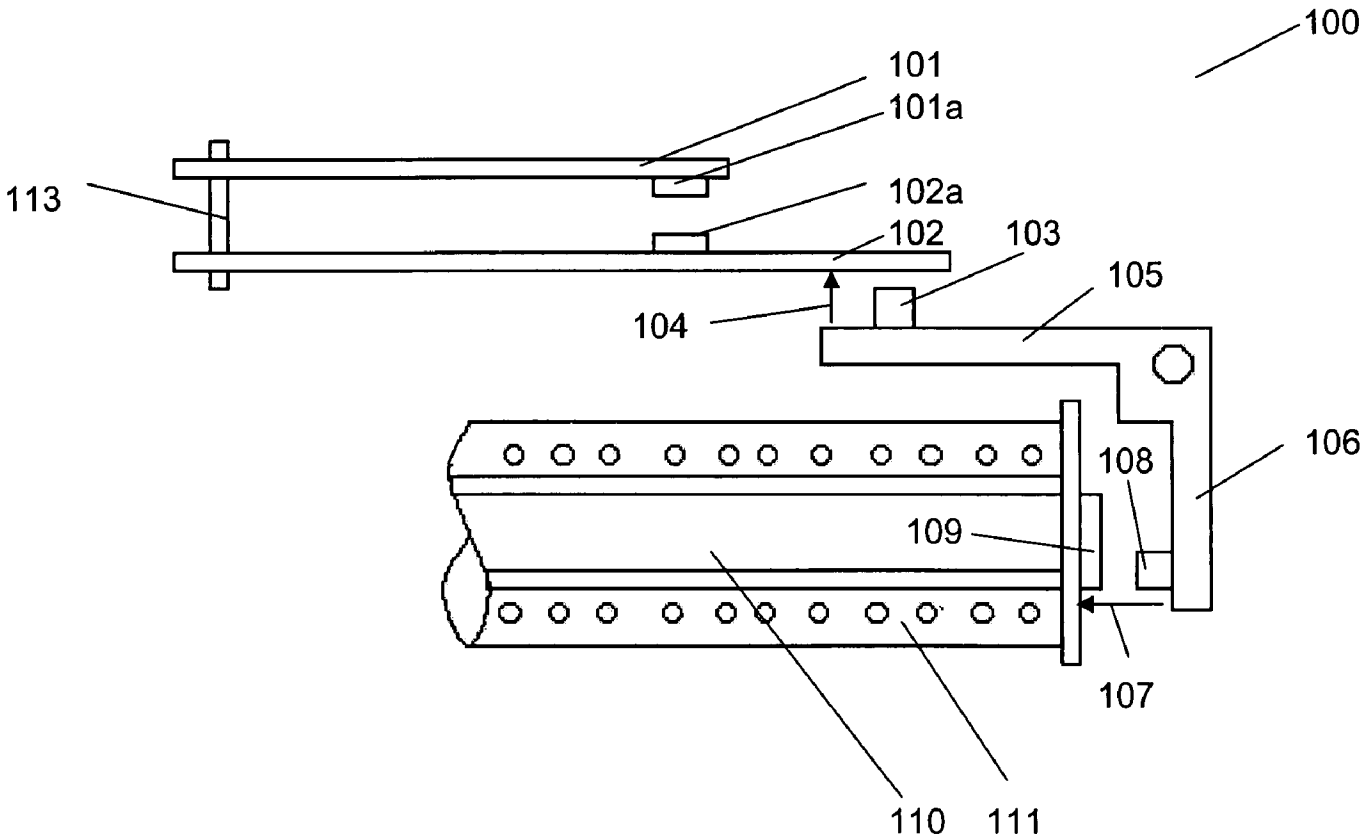
FIG. 1 (PRIOR ART)
FIG. 1 shows an illustrative prior art electromechanical electrical switch.
Figure 2:
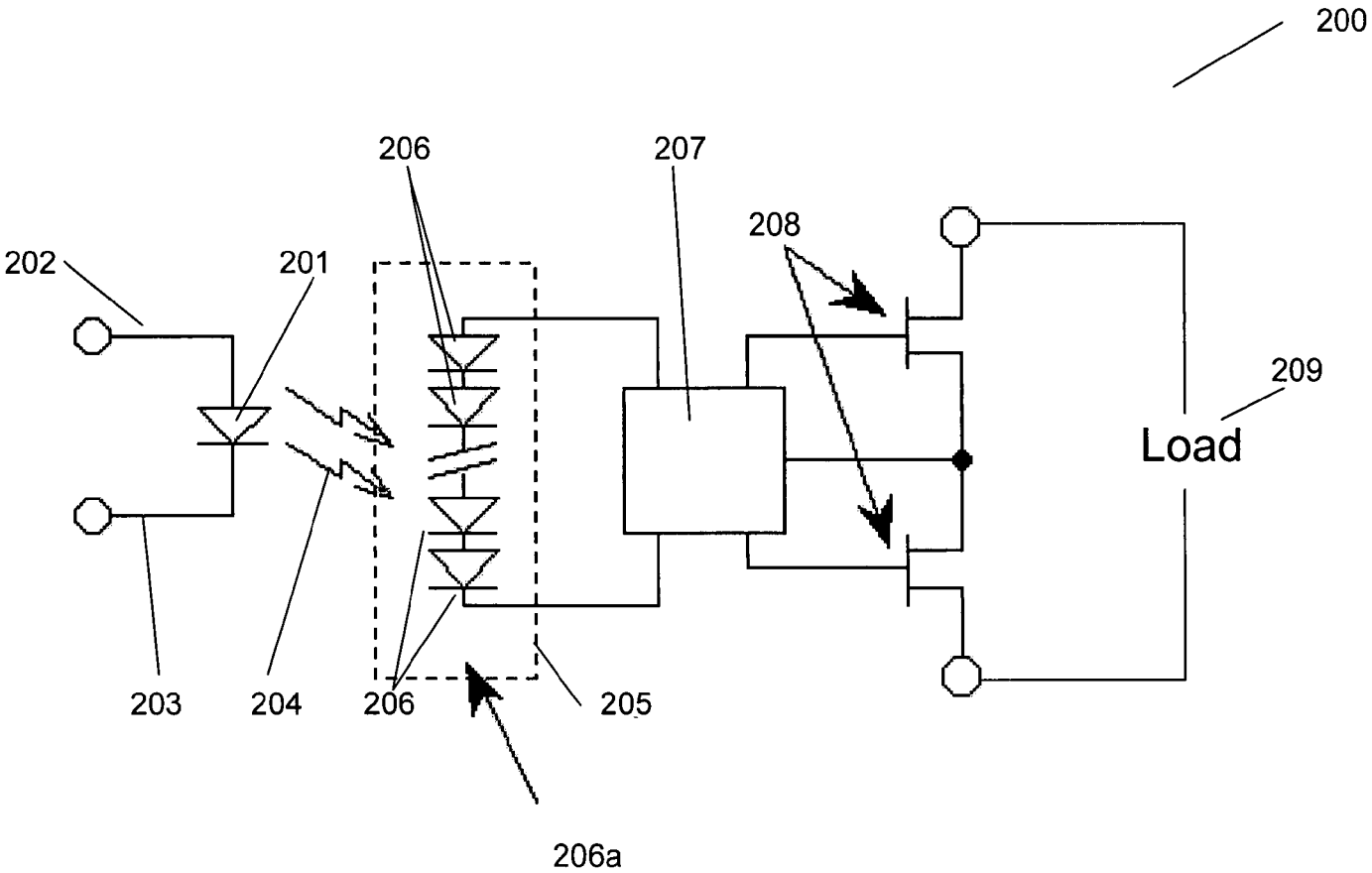
FIG. 2 (PRIOR ART)
FIG. 2 shows an illustrative prior art solid state relay.
Figure 3:
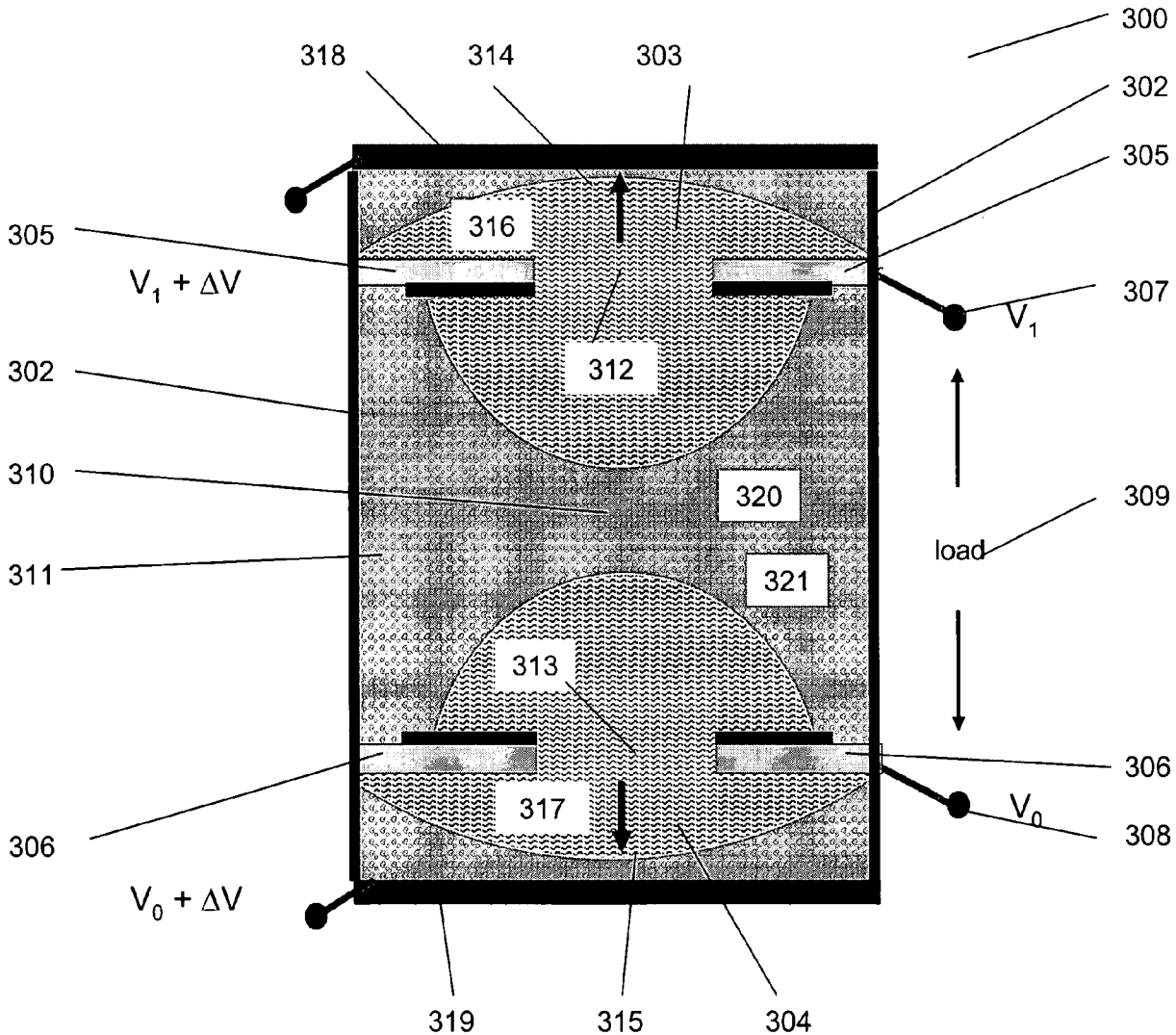
FIG. 3 shows one illustrative embodiment of a present invention showing a cathenoid electrical microswitch in a open position.

FIG. 3 shows one embodiment in accordance with the principles of the present invention of a liquid electrical microswitch, specifically a catenoid structured liquid electrical switch. More specifically, FIG. 3 represents a cross sectional view of a liquid electrical switch 301 having outer housing 302 that is, illustratively, cylindrical in shape. Illustratively, having a diameter between 10 and 500 micrometers. One skilled in the art will recognize that many suitable shapes and sizes may be chosen to achieve the teachings of the principles of the present invention. Illustrative electrodes 318 and 319 are disposed at the ends of the illustrative cylinder. Within housing 302, droplets 303 and 304 are positioned on the opposing sides of two conductive plates, 305 and 306 respectively, which are electrically connected to the switching terminals 307 and 308, also respectively that are in turn connected to an electrical load 309 for which switching is desired. Droplets 303 and 304 may be selected from a wide variety of desirable conductive liquids, such as, illustratively, ionic liquids, aqueous salt solutions, liquid metals, etc. One skilled in the art will recognize that many different liquids may be chosen advantageously for the droplet in accordance with the principles of the present invention.

Conductive droplets 303 and 304 are, illustratively, surrounded by a dielectric confinement fluid 310 which is, for example, immiscible and density-matched with the liquid chosen for droplets 303 and 304. Such a confinement liquid is used, for example, in order to prevent evaporation of the droplets 303 and 304, as well as to ensure gravity-independent, vibration and shock-resistant operation of the switch 300. A number of common fluids can serve as a confinement fluid, including silicone oils, alkanes, and alcohols. Once gain, one skilled in the art will fully appreciate in light of the teachings herein that any number of suitable liquids may be chosen to achieve the principles described herein.

Liquid droplets 303 and 304 are, illustratively, allowed to penetrate partially into the chamber 311 between plates 305 and 306 via holes 312 and 313, respectively. In operation, in order to maintain a separation between the two droplets 303 and 304 (i.e., maintain an open switch), a voltage differential is applied between electrode 318 and droplet 313, as well as between electrode 319 and droplet 304. For example, in the representative example of FIG. 3, voltage $V_1$ is applied to lead 307, and hence to conducting plate 305 and droplet 303. Similarly, a voltage $V_0$ is applied to lead 308 and, hence, to conducting plate 306 and droplet 304. A voltage differential is, therefore, created between the conducting plates and droplets by, illustratively, applying a voltage of $V_1+\cdot V$ to electrode 318 and a voltage of $V_0+\cdot V$ to electrode 319. The result is to draw the top portion 314 of droplet 303 in direction 316 toward electrode 318 and to draw the top portion 315 of droplet 304 in direction 317 toward electrode 319, thus pulling the bottom portions 320 and 321 of droplets 303 and 304, respectively, away from each other. Thus, an open electrical switch is created whereby substantially no electrical charge is conducted between the two droplets 303 and 304.

Figure 4:
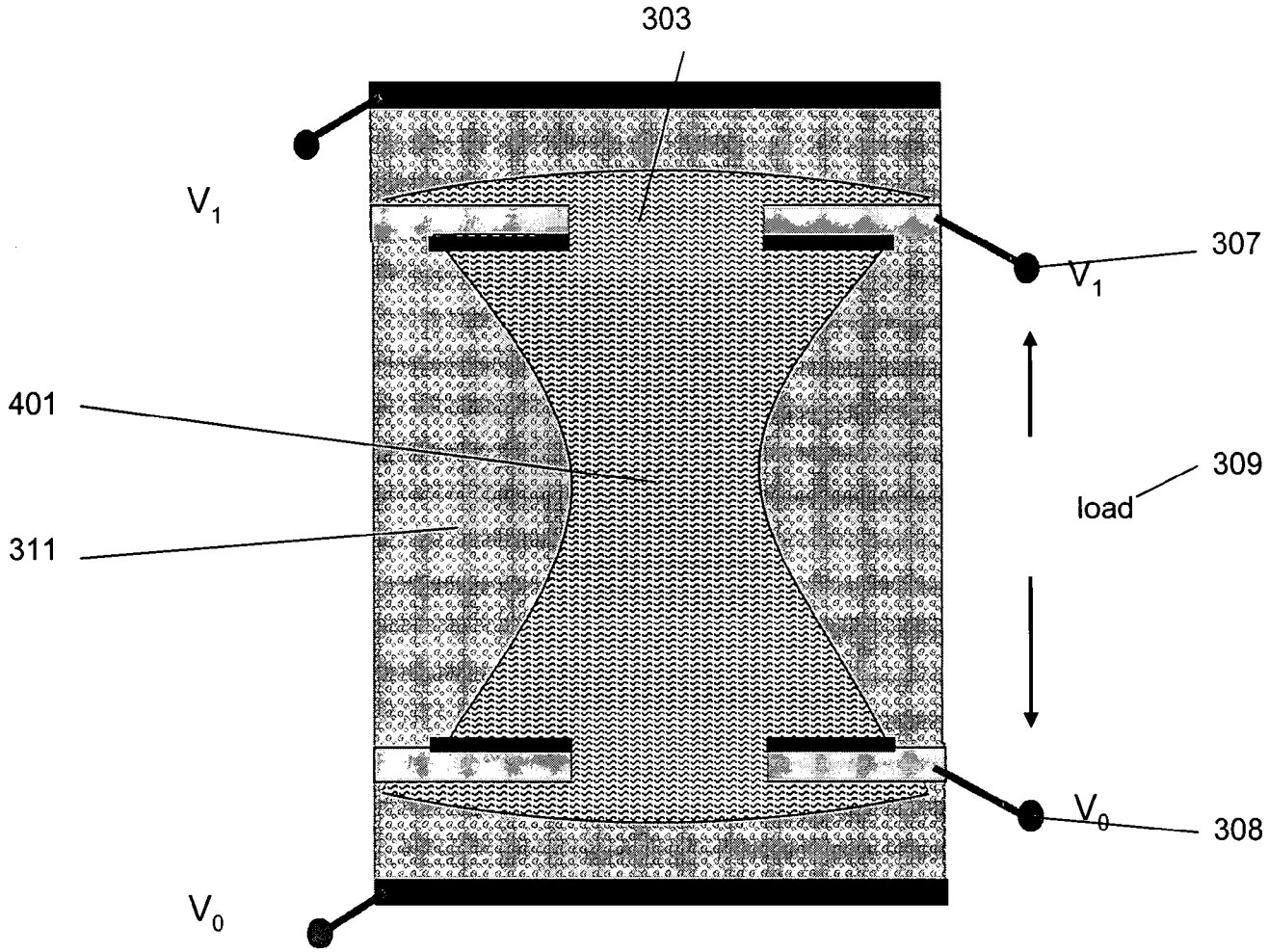
FIG. 4 shows the illustrative microswitch of FIG. 3 wherein the microswitch is in an closed position.

FIG. 4 shows the electrical switch of FIG. 3 that is configured in the closed, or on, position. Referring to FIG. 4, in order to establish electrical connection between leads 307 and 308, the liquid is expelled from both upper chamber 402 and lower chamber 403 until the droplets 303 and 304 come into contact with each other so that an electrically conductive liquid bridge 401 is formed between conducting plates 305 and 306. This expelling of liquid from chambers 402 and 403 is, for example, caused by removing the aforementioned voltage differential between the droplets 303 and 304 and the conducting plates 305 and 306, respectively. Once these differentials are removed, some of the liquid in the upper portions 316 and 317 of droplets 303 and 304, respectively, is pushed back into chamber 311 by the pressure exerted on the droplets by the immiscible liquid surrounding the droplets in the upper and lower chambers 402 and 403. Once the droplets 303 and 304 are allowed to penetrate into chamber 311, they contact each other thus forming, illustratively, a catenoid-shaped liquid bridge 401 between the conducting droplets 303 and 304. Electricity is thus permitted to flow between the two droplets to supply power to load 309.

To open the switch once again (i.e., turn the switch to the off position), it is only necessary to reapply a voltage potential between the droplets 303 and 304 and the electrodes 305 and 306. This will serve to draw the liquid droplets closer to the respective electrodes and, accordingly, as the liquid is withdrawn back to the upper and lower chambers 402 and 403, the liquid bridge 401 collapses and the electrical connection between leads 307 and 308 is terminated.

The embodiments of FIG. 3 and FIG. 4 show that the amount of the liquid in each chamber can be changed by electrostatically adjusting the curvature of the surface of the liquid that fills the chamber. One skilled in the art will be able to devise, in light of the teachings herein, alternate methods of altering the amount of liquid in the chambers. For example, this can be achieved by changing the pressure in the upper an dlower chambers, utilizing electrocapillary mechanisms or, alternatively, electrowetting mechanisms. One skilled in the art will recognize that these methods have been shown to be effective at controlling the geometry of the liquid microdroplets. For example, if pressure changes were relied upon, increasing the pressure within the upper and lower chambers could be used to expel a portion of one or both of the liquid droplets from the chambers so that the droplets contacted each other. A reduction of pressure within the chambers would have the opposite effect and would draw more of the droplet into the chambers, thus breaking the contact between the droplets. Such pressure changes could be achieved, for example, through the use of thermal energy by heating or cooling the liquid in the upper and/or lower chambers. One skilled in the art will recognize that, by heating the liquid, the droplet will be expelled from the chamber and by cooling the liquid, the droplet will be drawn back into the chamber.

If electrocapillary actuation were used, an illustrative electrolite (such as aqueous solution of potassium chloride (KCl) is used as a secondary liquid filling the chamber and an illustrative liquid metal (such as mercury) is used for the droplet liquid. A charged double layer is formed between the droplet and surrounding liquid that prevents the current from flowing through the liquid-to-liquid interface and thus provide electrical isloation between the two liquids. By applying a voltage differential between the droplet and surrounding electrolite the charge density of the double layer is changed and, as a result, the surface tension of the liquid-to-liquid interface is changed. Since the surface tension of this interface determines the curvature of the droplet, the amount of the liquid in the chamber will be changed as well. Electrocapillarity is a well known effect and is described in detail in many publications such as, for example, the book A. Adamson, Physical Chemistry of Surfaces, John Wieley & Sons, Inc., 1990.

Similarly, if electrowetting were used, the contact angle of the conducting droplet could be made to change, thus altering the amount of liquid is in the chamber. Electrowetting as applied to changing the contact of a liquid microlens with a substrate is described generally in U.S. patent application Ser. No. 10/139,124, titled "Method And Apparatus For Calibrating A Tunable Microlens," and is hereby incorporated by reference herein in its entirety.

One skilled in the art will recognize that the liquid microswitches thus described herein can be easily integrated in high-density two-dimensional arrays, thus opening the way to creating very large switching fabrics. In this case self-assembly techniques can be utilized to allow the liquid microdroplets to arrange themselves in the appropriate geometrical pattern without the need for special assembly. Such techniques are described in U.S. patent application Ser. No. 10/403,159, titled "Method and Apparatus for Variably Controlling the Movemenet of A Liquid on a Nanostructured Surface," and filed Mar. 31, 2003, which is hereby incorporated by reference herein in its entirety. One skilled in the art will realize that, in addition to the methods discussed in the '159 application, such self assembly can be achieved by selectively patterning the plates with the alternating pattern of the high and low surface energy coatings, thus attracting liquids to desired locations on the aforementioned switching fabric.

The advanced liquid-based microswitches described herein are advantageous in many regards. In addition to a relatively low-cost manufacturing process, for example, switches in accordance with the principles of the present invention are characterized in part by having no moving parts, other than the liquid droplets. Electrical connections are established and broken by actively changing the shape of the liquid droplets that remain stationary with respect to the rest of the device. As a result, mechanical wear, one of the leading causes of failure in traditional switches, is substantially eliminated with switches in accordance with the principles of the present invention. Additionally, the switches described herein have no physical contact-to-contact interface in the flow path of electrical current. As described above, electrical current is always conducted through the continuous illustrative catenoid body of the liquid (liquid bridge), which is formed between the neighboring droplets during each switching cycle. This eliminates chemical and electrochemical degradation of the contacts—another important failure mechanism common in traditional, prior switches. Finally, the proposed liquid-to-liquid contact design also provides for zero OFF state current (high isolation), very low ON state resistance, and high-speed, bounce-free operation. Thus, the liquid switches described herein seamlessly combine exceptional reliability, with high performance, small size, and low-cost.

The foregoing merely illustrates the principles of the invention. It will thus be appreciated that those skilled in the art will be able to devise various arrangements which, although not explicitly described or shown herein, embody the principles of the invention and are within its spirit and scope. Furthermore, all examples and conditional language recited herein are intended expressly to be only for pedagogical purposes to aid the reader in understanding the principles of the invention and are to be construed as being without limitation to such specifically recited examples and conditions. Moreover, all statements herein reciting aspects and embodiments of the invention, as well as specific examples thereof, are intended to encompass functional equivalents thereof.

What is claimed is:

1. An electrical switch comprising:

a first conducting droplet having a first voltage;

a second conducting droplet having a second voltage; and means for reversibly contacting said first droplet with said second droplet; said reversibly contacting said first droplet with said second droplet occurring within a housing of said electrical switch and as a function of capillary action; and wherein said first conducting droplet and said second conducting droplet remain stationary with respect to said housing of said electrical switch.

2. The electrical switch of claim 1 wherein said means for contacting comprises:

means for creating a first voltage differential between said first droplet and a first electrode; and means for creating a second voltage differential between said second droplet and a second electrode.

3. The apparatus of claim 2 wherein said means for creating a first voltage differential comprises at least a first voltage source electrically connected to said first electrode and said first droplet, said first electrode electrically insulated from said first droplet.

4. The apparatus of claim 2 wherein said means for creating a second voltage potential comprises at least a first voltage source electrically connected to said second electrode and said second droplet, said second electrode electrically insulated from said second droplet.

5. The apparatus of claim 1 wherein said means for reversibly contacting said first droplet with said second droplet comprises a heat source for increasing the pressure applied to said first droplet, thus causing said first droplet to contact said second droplet.

6. An electrical switch comprising:

a first conducting droplet having a first voltage;

a second conducting droplet having a second voltage;

a first electrode in proximity to said first conducting droplet;

a second electrode in proximity to said second conducting droplet;

at least a first voltage source for applying a voltage to at least said first electrode such that said first conducting droplet is separated, as a function of capillary action, from said second conducting droplet within a housing of said electrical switch, thereby preventing an electrical current from flowing from said first conducting droplet of liquid to said second conducting droplet of liquid; and wherein said first conducting droplet and said second conducting droplet remain stationary with respect to said housing of said electrical switch.

7. The electrical switch of claim 6 further comprising a first fluid surrounding said first conducting droplet, said fluid immiscible with said first conducting droplet.

8. The electrical switch of claim 7 further comprising a second fluid surrounding said first conducting droplet, said fluid immiscible with said first conducting droplet.

9. The electrical switch of claim 8 wherein said first fluid and said second fluid comprise the same fluid.

10. A method for use with a switch in an electrical circuit, said switch comprising a first conducting droplet of liquid and a second conducting droplet of liquid, said first conducting liquid droplet and said second conducting liquid droplet being disposed within a housing of said electrical circuit, said method comprising:

contacting, as a function of capillary action, said first conducting droplet of liquid with said second conducting droplet of liquid in a way such that an electrical path is formed between said first conducting droplet of liquid and said second conducting droplet of liquid, and said first conducting droplet and said second conducting droplet remain stationary with respect to said housing of said electrical switch.

11. The method of claim 10 further comprising:

separating said first conducting droplet of liquid from said second conducting droplet of liquid in a way such that said electrical path is removed.

12. A method for opening a switch in an electrical circuit, said switch having a first conducting droplet of liquid and a second conducting droplet of liquid disposed in a housing, and wherein, when contacted, said first and second conducting droplets form an electrical path, said method comprising:

applying a first voltage differential between a first electrode and said first conducting droplet of liquid; and applying a second voltage differential between a second electrode and said second conducting droplet of liquid, wherein, upon applying said first voltage differential and said second voltage differential, said first conducting droplet is separated, as a function of capillary action, from said second conducting droplet, thus preventing an electrical current from flowing from said first conducting droplet of liquid to said second conducting droplet of liquid; and wherein said first conducting droplet and said second conducting droplet remain stationary with respect to said housing.

* * * * *